US007473073B1

(12) United States Patent
Liang

(10) Patent No.: US 7,473,073 B1
(45) Date of Patent: Jan. 6, 2009

(54) TURBINE BLADE WITH COOLED TIP RAIL

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 366 days.

(21) Appl. No.: 11/453,432

(22) Filed: Jun. 14, 2006

(51) Int. Cl.
*F01D 5/18* (2006.01)

(52) U.S. Cl. ..... 415/173.5; 415/174.4

(58) Field of Classification Search ..... 415/115, 415/174.4, 173.5; 416/90 R, 92, 96 R, 97 R
See application file for complete search history.

(56) References Cited

U.S. PATENT DOCUMENTS 5,261,789 A * 11/1993 Butts et al. ..... 416/96 R
5,660,523 A 8/1997 Lee
5,733,102 A 3/1998 Lee et al.
6,059,530 A * 5/2000 Lee ..... 416/97 R
6,164,914 A 12/2000 Correia et al.
6,190,129 B1 * 2/2001 Mayer et al. ..... 416/97 R
6,224,336 B1 * 5/2001 Kercher ..... 416/97 R
6,231,307 B1 5/2001 Correia et al.
6,527,514 B2 3/2003 Roeloffs
6,602,052 B2 8/2003 Liang
6,672,829 B1 * 1/2004 Cherry et al. ..... 415/115
6,790,005 B2 * 9/2004 Lee et al. ..... 416/97 R
6,991,430 B2 * 1/2006 Stec et al. ..... 416/97 R
6,994,514 B2 2/2006 Soechting et al.
7,029,235 B2 4/2006 Liang
7,270,514 B2 * 9/2007 Lee ..... 416/92
7,281,894 B2 * 10/2007 Lee et al. ..... 416/92

FOREIGN PATENT DOCUMENTS

FR 2885645 A1 * 11/2006

* cited by examiner

*Primary Examiner*—Igor Kershteyn
(74) *Attorney, Agent, or Firm*—John Ryznic

(57) ABSTRACT

A turbine blade for a gas turbine engine with a tip rail that forms a gap between the blade and the turbine shroud, where the tip rail is located near to the suction side wall of the blade and offset there from, and where the tip rail includes sidewalls that are slanted inward from top to bottom to form a vortex pocket on the sides of the tip rail. Film cooling holes open out into the vortex pockets on both sides of the tip rail to supply cooling air. Film cooling holes located on the upstream side of the squealer tip and on the pressure side wall of the blade force the hot gas leakage flow to flow over the squealer tip while the cooling air in the vortex pockets flows in a vortex flow pattern to force the hot gas leakage flow off of the rail tip and further toward the blade outer air seal. The leakage flow past the tip rail forms a vortex flow path downstream of the tip rail on the airfoil suction side wall while the cooling air forms a counter vortex flow within the vortex pockets to trap the flow within the vortex pocket, resulting in a longer duration of time in which the flow occurs in the pockets for cooling of the tip rail.

16 Claims, 4 Drawing Sheets

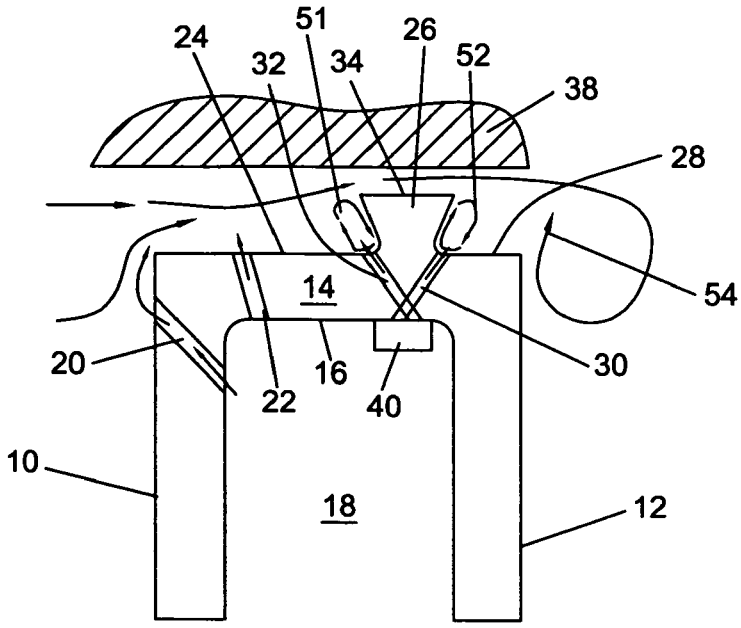
Fig 7
Fig 6
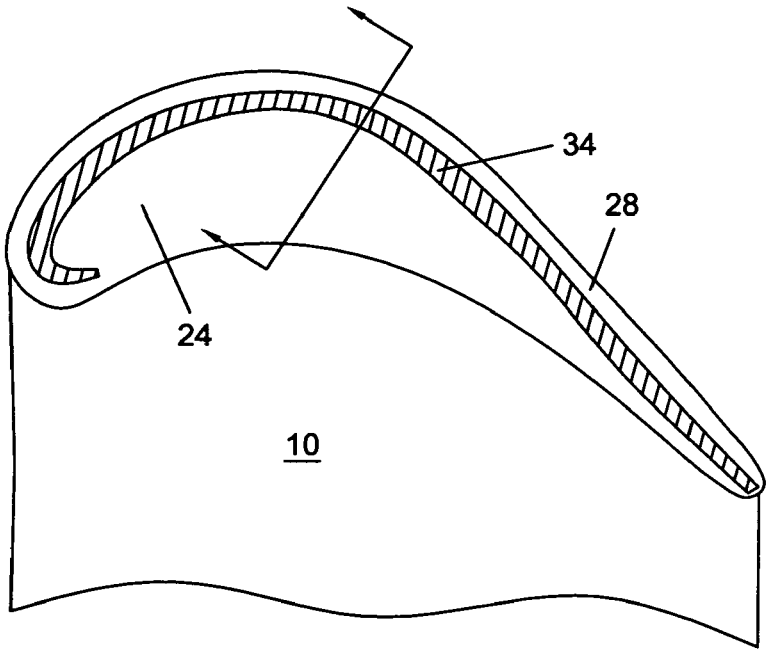
Fig 8

TURBINE BLADE WITH COOLED TIP RAIL

CROSS-REFERENCE TO RELATED APPLICATIONS

None.

STATEMENT REGARDING FEDERALLY SPONSORED RESEARCH OR DEVELOPMENT

None.

BACKGROUND OF THE INVENTION

1. Field of the Invention

The present invention relates generally to gas turbine engines, and more specifically to turbine blade cooling.

2. Description of the Related Art Including Information Disclosed Under 37 CFR 1.97 and 1.98

One method of improving the efficiency of a gas turbine engine is to increase the temperature of the hot gas stream that passes through the turbine. In order to allow for a higher gas temperature in the turbine, one way designers meet this challenge is to provide more effective blade cooling in order that the blade materials can withstand the higher temperature.

Turbine blades are therefore cooled by passing a cooling fluid such as compressed air through serpentine passageways in the blade. Cooling air is also discharge into the gas stream through cooling holes strategically placed to provide an air cushion on the hottest surfaces of the blade. Examples of cooling methods for turbine blades include convection cooling and impingement cooling in which the cooling fluid passes through the inside of the turbine blade, and film cooling in which the cooling fluid is ejected to the outside surface of the turbine blade to form a film of cooling fluid.

Squealer tips have been used on the tips of turbine blades to provide a seal between the rotating turbine blade and the stationary blade outer air seal (BOAS). Increased engine efficiency is obtained when the gap between the tip and the turbine shroud is minimized. The tip clearance is limited by the differential thermal expansion and contraction between the blade and the turbine shroud. If rubbing occurs, the effects will be minimal because of the low surface area exposed to the rubbing due to the squealer tips. Leakage of the hot gas flow through the gap formed between the blade tip and the turbine shroud decreases the efficiency of the engine, and also allows for the blade tip and blade outer surface to be exposed to the hot gas flow that can damage the blade and tip. The squealer tip is typically of small thickness and particularly susceptible to high temperature oxidation and other damage due to overheating. The blade tip is particularly difficult to cool since it is located directly adjacent to the turbine shroud, and the hot combustion gas flow passes through the tip gap.

High temperature turbine blade tip section heat load is a function of the blade tip leakage flow. A high leakage flow will induce a high heat load onto the blade tip section. Therefore, the blade tip section sealing and cooling must be addressed as a single problem. Traditionally, a typical turbine blade tip includes a squealer tip rail which extends around the perimeter of the airfoil flush with the airfoil wall such that an inner squealer pocket is formed. The main purpose of incorporating a squealer tip in a blade design is to reduce the blade tip leakage and also to provide for rubbing capability for the blade. FIG. 1 shows a squealer tip cooling arrangement. Film cooling holes are formed along the airfoil pressure side tip section, and extend from a leading edge to a trailing edge in order to provide for edge cooling of the blade pressure side squealer tip. In addition, convective cooling holes are also formed along the tip rail at an inner portion of the squealer pocket in order to provide additional cooling for the squealer tip rail. Secondary hot gas flow migration around the blade tip section is also shown in FIG. 1. the blade includes a pressure side 110, a squealer tip 134 forming a squealer pocket 124, cooling holes along the pressure side airfoil surface, and cooling holes 122 adjacent to the sides of the squealer tip 134.

U.S. Pat. No. 6,994,514 B2 issued to Soechting et al on Feb. 7, 2006 shown in FIG. 2 shows a TURBINE BLADE AND GAS TURBINE with a cooling concept for the blade suction side tip rail in which the blade includes a pressure side 236, a suction side 235, a squealer tip 237, film cooling holes 238 near to suction side, and film cooling holes 239 near the pressure side for the blade. The suction side blade tip rail 237 is subject to heating due to the hot gas flow over the blade tip from three exposed sides, cooling of the suction side squealer tip rail 237 by means of discharge row of film cooling holes 239 along the blade pressure side peripheral and at the bottom of the squealer floor becomes insufficient. This is primary due to the combination of tip rail geometry and the interaction of hot gas secondary flow mixing, whereby the effectiveness induced by the pressure side film cooling and tip section convective cooling holes is very limited.

FIG. 3 is from the U.S. Pat. No. 6,527,514 B2 issued to Roeloffs on Mar. 4, 2003 entitled TURBINE BLADE WITH RUB TOLERANT COOLING CONSTRUCTION and shows a turbine blade with a pressure side 302, a suction side 303, a tip cap 304 having an inner surface 314, a blade hollow space 305, a pressure side tip crown 307, a suction side tip crown 308, a pressure side cooling passage 325 opening onto film cooling holes 310 on the pressure side surface of the blade, and a cooling passage 315 extending in a first portion 317 from the hollow space 305 through the tip cap 304 to an exit hole opening into a cavity 316 and then through an exit hole 311 opening onto the suction side tip squealer 308. A tip pocket 309 is formed between the two squealer tips 307 and 308.

FIG. 4 is from the U.S. Pat. No. 6,602,052 B2 issued to Liang on Aug. 5, 2003 and shows an AIRFOIL TIP SQUEALER COOLING CONSTRUCTION in which a turbine blade with a pressure side 402 and suction side 403, a blade tip cap 404 with a pressure side squealer tip 407 and a suction side squealer tip 408, a tip pocket 409 formed between the two squealer tips 407 and 408, film cooling holes 418 opening onto the pressure side airfoil surface, and film cooling holes 414 adjacent to the suction side squealer tip 408.

FIG. 5 is form the U.S. Pat. No. 6,059,530 issued to Lee on May 9, 2000 entitled TWIN RIB TURBINE BLADE and shows a turbine blade with a pressure side 528 and a suction side 530, a first squealer tip 550 and a second squealer tip 552, a tip channel 554 formed between the two tips 550 and 552, an internal flow channel or chamber 540, and two film cooling holes 562 to supply cooling air to the pressure side of the first tip 550. Cooling air is also discharged into the tip channel 554 for mixing with the combustion gases to further decrease the temperature of the gases for cooling both tip ribs and their inboard sides.

FIG. 6 shows the U.S. Pat. No. 6,991,430 B2 issued to Stec et al on Jan. 31, 2006 entitled TURBINE BLADE WITH RECESSED SQUEALER TIP AND SHELF with a turbine blade having a pressure side 624, a suction side 626, a continuous tip squealer wall 662 extending around the tip of the blade and forming a tip cavity 640, and a recessed tip wall portion 645 recessed inboard from the pressure side of the airfoil wall forming a tip shelf 647 there between. A plurality of film cooling shelf holes 652 in the tip cap 622 supply cooling air to the recessed tip wall 645, and a plurality of film cooling holes 646 supply cooling air to the tip cavity 640.

It is an object of the present invention to provide for turbine blade of a gas turbine engine with improved tip cooling.

It is another object of the present invention to provide for a turbine blade tip with improved sealing between the tip and the turbine shroud.

BRIEF SUMMARY OF THE INVENTION

The blade tip leakage flow and cooling problems of the prior art are alleviated by incorporation of the squealer tip configuration of the present invention that provides for improved sealing and cooling geometry into the airfoil suction side tip rail cooling design. A tip rail is off-set from the suction side wall of the blade to form a tip cap ledge between the tip rail and the suction side wall of the blade. The tip rail including side walls slanted inward at the bottom to produce vortex convection cooling pockets along both sides of the tip rail, providing for improved sealing and cooling of the tip rail. Film cooling holes open onto both vortex pockets of the tip rail to provide cooling air that forms a vortex flow path in the vortex pockets of the tip rail. The vortex flow path in the pockets acts to push the hot gas flow toward the BOAS which reduces the effective leakage flow area (this translate into the reduction of leakage flow) and also off of the tip rail lower the heat transfer to the tip rail. A vortex in the hot gas stream downstream of the tip rail is developed by the leakage flow while the cooling air injected in the vortex flow pockets retain within the pocket for a longer period of time.

BRIEF DESCRIPTION OF THE SEVERAL VIEWS OF THE DRAWINGS

FIG. 7 shows a cross section view of a turbine blade of the present invention.

FIG. 8 shows a top perspective view of the turbine blade of the present invention.

DETAILED DESCRIPTION OF THE INVENTION

Figure 1:
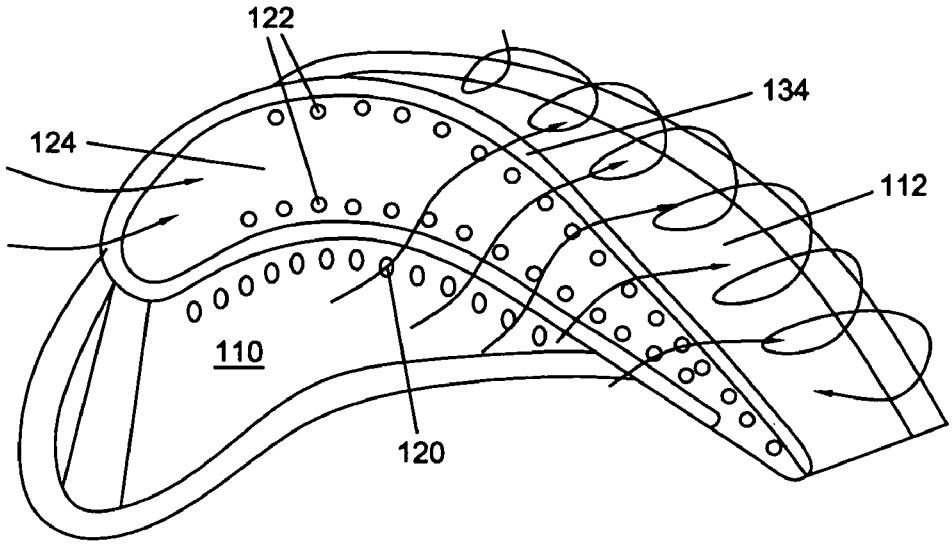
Fig 1 prior art
FIG. 1 shows a top perspective view of a Prior Art turbine blade and hot gas flow path.
Figure 2:
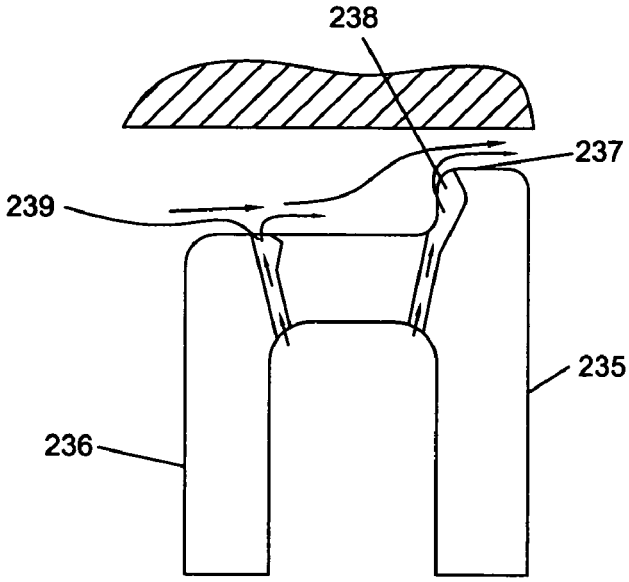
Fig 2 prior art
FIG. 2 shows a cross section view of a Prior Art turbine blade with a squealer tip along the suction side wall of the blade.
Figure 3:
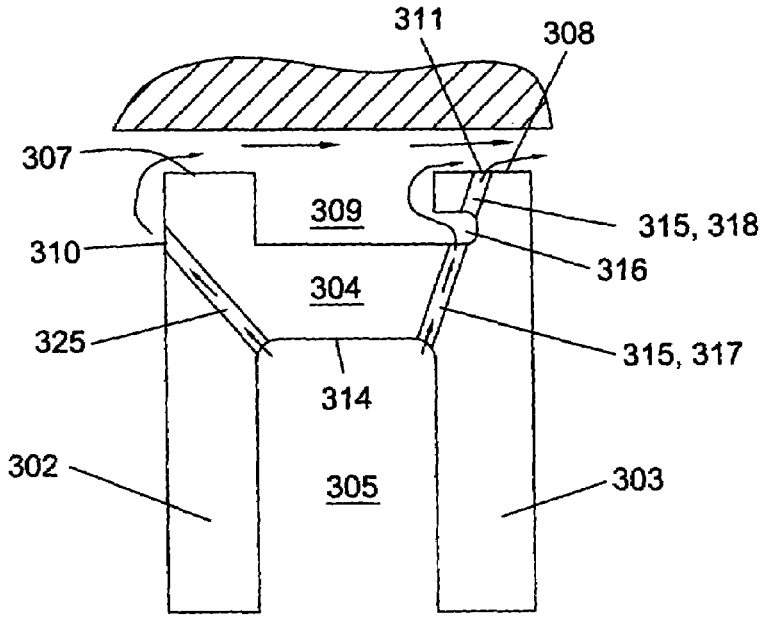
Fig 3 prior art
FIG. 3 shows a cross section view of a Prior Art turbine blade with a squealer tip formed along the pressure side and suction side walls of the blade and forming an enclosed pocket.
Figure 4:
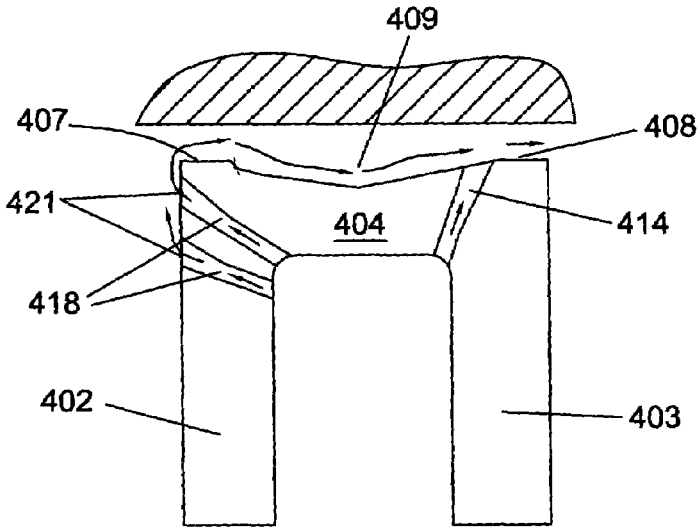
Fig 4 prior art
FIG. 4 shows a cross section view of a Prior Art turbine blade with a squealer tip forming a pocket, the pocket being formed with a smooth contour for an even flow of cooling fluid.
Figure 5:
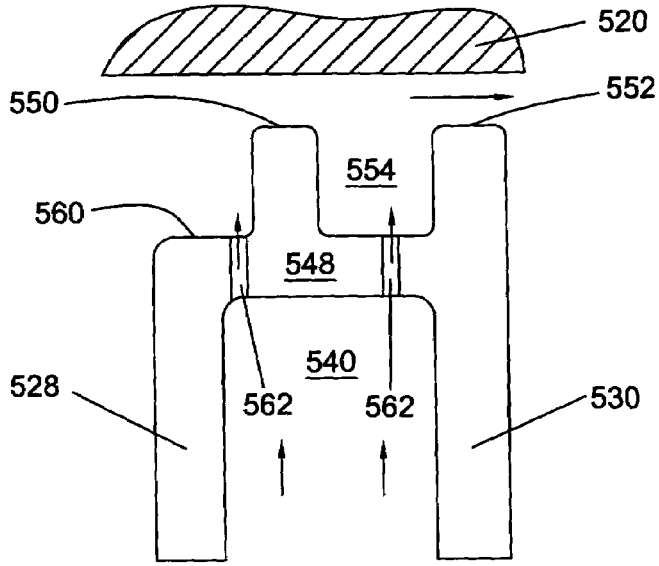
Fig 5 prior art
FIG. 5 shows a cross section view of a Prior Art turbine blade with a pressure side squealer tip and a suction side squealer tip with a tip inlet and a tip outlet located between the two squealer tips.
Figure 6:
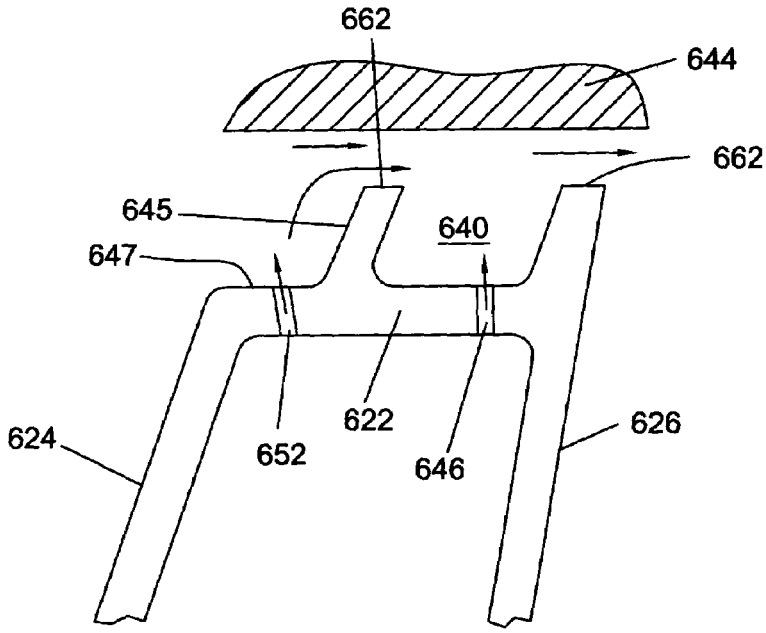
Fig 6 prior art
FIG. 6 shows a cross section view of a Prior Art turbine blade with a continuous squealer tip wall and a recessed tip wall portion forming a tip shelf on the pressure side of the blade.

The present invention is shown in FIGS. 7 and 8. A turbine blade in a gas turbine engine includes a pressure side airfoil surface 10, a suction side airfoil surface 12 and a blade tip cap 14. Within the blade is a series of cooling fluid passages that forms a cooling cavity 18. On the downstream side of the tip cap is formed a squealer tip (or, tip rail) 26 having a tip rail crown 34 that forms a gap between a turbine shroud 38. the tip rail 26 is offset a distance from the suction side wall of the blade such that a tip cap 28 is formed on the downstream side of the tip rail 26. This downstream tip cap surface 28 forms part of the vortex flow pocket on the downstream side of the tip rail 26. A plurality of film cooling holes 20 open onto the pressure side surface 10 of the blade near the top of the tip cap 14. A plurality of film cooling holes 22 open onto the tip cap 14 near the upstream end of the tip cap. Film cooling holes 20 and 22 are in fluid communication with the cooling cavity 18 to provide cooling fluid to the surfaces of the blade for film cooling effects.

The squealer tip 26 of the present invention has a unique cross sectional shape as seen in FIG. 7. The upstream side and the downstream side of the tip rail 26 has sides that are slanted inward from the top toward the bottom of the tip rail to form vortex convection cooling pockets. Additional film cooling holes 30 and 32 supply cooling air to the upstream side vortex pocket and the downstream side vortex pocket. The axis of the film cooling holes 30 and 32 are substantially aligned with the slanted sides of the tip rails in order that the film cooling air discharging from the cooling holes 30 and 32 will form a vortex flow path in the vortex pockets. The holes 30 and 32 alternate such that one hole 30 leading to the upstream side of the rail tip will be positioned between two holes 30 leading to the downstream side of the tip rail. An upstream vortex flow path 51 is shown on the upstream vortex pocket of the tip rail, and a downstream vortex flow path 52 is shown on the downstream vortex pocket, as shown by the arrows in FIG. 7. an extended surface such as fins 40 can be included on the upper surface 16 of the tip cap 14 adjacent to the entrances for the cooling holes 30 and 32 to enhance the tip rail backside convection. One or more fins 40 can be positioned midway between the holes 30 and 32.

As shown in FIG. 8, the tip rail 26 of the present invention extends from the pressure side of the airfoil at the leading edge and along the entire suction side of the blade, ending at the center of the trailing edge. Most of the pressure side of the blade is void of a tip rail. The tip rail is located at the middle of the airfoil at the trailing end. The last quarter length of the tip rail is located in the middle of the airfoil such that the cooling channels below the airfoil can be used to cool the tip rail. At the trailing edge of the blade, the cooling channel below is located midway between the pressure side and the suction side. Running the tip rail along the middle of the airfoil along the trailing end will position the tip rail directly over the cooling channel and provide improved cooling for the tip rail.

In operation, due to the pressure gradient across the airfoil from the pressure side to the suction side, the secondary flow near the pressure side surface migrates from the lower blade span upward across the blade end tip. On the pressure side corner of the airfoil, the secondary leakage flow entering the squealer pocket performs like a developing flow at a low heat transfer rate. The leakage flow is pushed upward by the pressure side film cooling flow when it enters the squealer tip channel. The pressure side cooling flow on the airfoil pressure side wall or on top of the pressure side tip pocket will push the near wall secondary leakage flow outward and against the oncoming stream wise leakage flow. This counter flow action reduces the oncoming leakage flow as well as pushes the leakage outward on the blade outer air seal. In addition to the counter flow action, the vortex convection cooling pocket at the pressure side of the tip rail, forming a cooling recirculation pocket by the tip rail, also forces the secondary flow to bend outward and, therefore, yields a smaller vena contractor and subsequently it reduces the effective leakage flow area. This reduces the blade leakage flow that occurs at the blade tip region. As the leakage flows through the blade end tip to the airfoil suction side wall, it creates a flow recirculation with the leakage flow downstream of the tip rail.

On the suction side of the airfoil, the suction side tip rail is cooled by cooling air recirculation within the vortex cooling pocket formed with the airfoil suction wall leakage vortex flow. Because the single suction side tip rail is located off-set from the airfoil suction side wall, the tip rail is also cooled by the through wall conduction of heat load into the convection cooling channel below. Extended surfaces such as fins can be used under the suction side tip rail to enhance tip rail backside convection.

The creation of the above described leakage flow resistance by the suction side blade end tip geometry and cooling flow injection results in a very high resistance for the leakage flow path and, thus, reduces the blade leakage flow and heat load. As a result, the present invention reduces the blade tip section cooling flow requirement.

The present invention provides major advances over the sealing and cooling methods of the Prior Art squealer tip cooling designs. These advances includes: 1) the uniqueness of the blade end tip geometry and cooling air injection induces a very effective blade cooling and sealing for both the pressure and suction walls. The built-in vortex pockets in the tip sealing rail performs like a double rail seal for the blade end tip region; 2) the off-set suction side tip rail geometry combines with the radial convective cooling holes along the tip rail to form a cooling pocket which creates a cooling vortex and traps the cooling flow longer, therefore providing improved cooling for the tip rail and the blade squealer pocket floor; 3) lower blade tip section cooling air demand due to lower blade leakage flow; 4) higher turbine efficiency due to low blade leakage flow; 5) reduction of the blade tip section heat load due to low leakage flow which increases the blade usage life; 6) the offset tip sealing rail configuration has enhanced cooling for the blade suction side tip section. It contains a higher convective cooling area than the Prior Art squealer tips. In addition, it also enhances conduction downward to the cooling channel beneath the squealer pocket floor. The combined effect reduces the tip rail metal temperature as well as thermal gradient through the squealer tip, and therefore reduces thermally induced stress and prolongs the blade useful life.

The invention claimed is:

1. A turbine blade comprising:

a pressure side wall and a suction side wall extending between a leading edge and a trailing edge and forming an airfoil;

a blade tip;

the blade tip having a single tip rail extending along the suction side, wherein a pressure side of the tip is free from the tip rail; and, the suction side tip rail offset from the suction side wall such that convective cooling of the tip wall below the tip rail can occur.

2. The turbine blade of claim 1, and further comprising:

the tip rail includes a flat crown that forms a seal with a blade outer air seal of a turbine section.

3. The turbine blade of claim 1, and further comprising:

a film cooling hole opening on top the pressure side wall near a tip corner and angled to discharge film cooling air up and over the tip corner.

4. The turbine blade of claim 1, and further comprising:

the suction side tip rail includes a forward side that is slanted toward the tip floor.

5. The turbine blade of claim 4, and further comprising:

a first tip cooling hole opening onto the tip floor adjacent to the tip rail on the forward side of the tip rail and parallel to the slanted side of the tip rail to discharge cooling air and form a vortex on the forward side of the tip rail.

6. The turbine blade of claim 4, and further comprising:

the suction side tip rail includes an aft side that is slanted toward the tip floor;

a first tip cooling hole opening onto the tip floor adjacent to the tip rail on the forward side of the tip rail and parallel to the forward slanted side of the tip rail to discharge cooling air and form a forward side vortex on the forward side of the tip rail; and, a second tip cooling hole opening onto the tip floor adjacent to the tip rail on the aft side of the tip rail and parallel to the aft slanted side of the tip rail to discharge cooling air and form a aft side vortex on the forward side of the tip rail.

7. The turbine blade of claim 5, and further comprising:

a third tip cooling hole opening onto the tip floor near the tip corner and angled slightly toward the tip corner.

8. The turbine blade of claim 5, and further comprising:

the tip rail extends around the leading edge and into the pressure side wall of the airfoil.

9. The turbine blade of claim 8, and further comprising:

the tip rail extends to the trailing edge of the airfoil.

10. The turbine blade of claim 1, and further comprising:

the tip rail extends around the leading edge and into the pressure side wall of the airfoil.

11. The turbine blade of claim 10, and further comprising:

the tip rail extends to the trailing edge of the airfoil.

12. The turbine blade of claim 3, and further comprising:

a plurality of heat transfer fins extending from a bottom surface of the tip rail and into a cooling air supply cavity, the fins being positioned between the openings of the tip floor cooling holes.

13. A process for cooling a blade tip of a turbine rotor blade, the rotor blade having a pressure side wall and a suction side wall extending between a leading edge and a trailing edge, the rotor blade having a single tip rail on the suction side of the tip, wherein a pressure side of the tip is free from the tip rail, the process comprising the steps of:

offsetting the tip rail front the suction side wall such that convective cooling of the bottom side of the tip rail can occur;

discharging a film cooling air from the pressure side wall in a direction up and over the tip corner; and, discharging tip cooling air on the forward side of the tip rail to form a vortex flow on the forward side of the tip rail.

14. The process for cooling a blade tip of claim 13, and further comprising the steps of:

forming the tip rail with the forward side slanted toward the tip floor; and, discharging the film cooling air onto the forward side of the tip rail at an angle parallel to the slanted forward side of the tip rail.

15. The process for cooling a blade tip of claim 14, and further comprising the steps of:

forming the tip rail with an aft side slanted toward the tip floor; and, discharging film cooling air onto the aft side of the tip rail at an angle parallel to the slanted forward side of the tip rail to form a vortex flow on the aft side of the tip rail.

16. The process for cooling a blade tip of claim 14, and further comprising the steps of:

discharging cooling air onto the tip floor at a location just downstream from the tip corner and slightly angled toward the tip corner in order to push the film cooling air from the pressure side wall up and into the tip rail crown.

* * * * *